United States Patent [19]

Takamiya

[11] 4,068,637

[45] Jan. 17, 1978

[54] MULTICYLINDER INTERNAL COMBUSTION ENGINE

[75] Inventor: Bonnosuke Takamiya, Jyoyo, Japan

[73] Assignee: Mitsubishi Jidosha Kogyo Kabushiki Kaisha, Japan

[21] Appl. No.: 731,013

[22] Filed: Oct. 8, 1976

[30] Foreign Application Priority Data

Oct. 24, 1975 Japan ..... 50-128720

[51] Int. Cl.[2] ..... F02M 25/06; F01N 3/15; F02B 75/10

[52] U.S. Cl. ..... 123/119 A; 123/52 M; 123/59 A; 123/119 R; 123/119 LR; 123/127; 60/274; 60/278

[58] Field of Search ..... 123/119 R, 119 A, 127 R, 123/119 LR, 59 A, 52 M, 52 MV; 60/274, 282, 285, 278

[56] References Cited

U.S. PATENT DOCUMENTS

| | | | |
|---|---|---|---|
| 3,943,906 | 3/1976 | Hirose et al. | 123/127 |
| 4,000,614 | 1/1977 | Abthoft et al. | 123/119 R |
| 4,006,722 | 2/1977 | Hata et al. | 123/127 |
| 4,024,708 | 5/1977 | Takemoto | 123/119 A |

*Primary Examiner*—Wendell E. Burns
*Attorney, Agent, or Firm*—Robert E. Burns; Emmanuel J. Lobato; Bruce L. Adams

[57] ABSTRACT

An automotive multicylinder internal combustion engine is liable to emit noxious gases under medium and low load conditions. Such air-polluting emissions as hydrocarbons, carbon monoxide and oxides of nitrogen are effectively reduced by supplying a rich mixture with air-fuel ratio of approximately 12 to 14 to a group of its cylinders, and a lean mixture with air-fuel ratio of approximately 17 to 20 to the remaining cylinders. While under high load conditions, substantially the same mixture with air-fuel ratio of approximately 13 to 15 is supplied to all the cylinders to prevent a drop in engine output and improve fuel economy.

6 Claims, 5 Drawing Figures

MULTICYLINDER INTERNAL COMBUSTION ENGINE

DETAILED DESCRIPTION OF THE INVENTION

This invention relates to improvements in an internal combustion engine, and more particularly to improvements in an automotive internal combustion engine. As is popularly known among skilled persons in the industry, a conventional automotive gasoline engine, which burns an air-fuel mixture slightly richer than the stoichiometric air-fuel ratio, emits much noxious compounds in its exhaust gases, such as nitrogen oxides (NOx), carbon monoxide (CO) and hydrocarbons (HC). Of these noxious compounds, HC and CO can be made innoxious by burning them, for instance, in a thermal reactor installed in the exhaust system or oxidizing them in a catalytic converter.

To do so, however, additional air, usually called the secondary air, must be supplied, as an oxygen source, to the engine exhaust system. It necessitates an air pump or other air supply means, which naturally makes the engine more costly. Meanwhile, it is known that the gasoline engine has the following characteristics:

1. The richer or leaner than stoichiometric the air-fuel mixtures, the lower the NOx concentration in their exhaust gases.

2. The richer than stoichiometric the air-fuel mixtures, the higher the CO and HC concentrations in their exhaust gases.

3. The leaner than stoichiometric the air-fuel mixtures, the lower the CO and HC concentrations in their exhaust gases, unless misfire occurs.

(Here air-fuel ratio means the ratio by weight of air to fuel in the air-fuel mixture.)

Multicylinder internal combustion engines taking advantage of the aforesaid three features have already been proposed, in which a lean mixture is supplied to half of the cylinders and a rich mixture to the remainder. The object of this invention is to improve such multicylinder engines. In this type of engine, the cylinders that burn lean mixture emit relatively small quantities of NOx, CO and HC, with much excess oxygen. Meanwhile, those burning rich mixture emit relatively less NOx but much CO and HC, with little excess oxygen.

By mixing in the exhaust system the exhaust gases from the rich mixture burning cylinders and the lean mixture burning cylinders, oxygen necessary for combusting the CO and HC, emitted mainly from the former cylinders, can be obtained from the exhaust gas from the latter cylinders. In the most ideal case, there is no need to supply any secondary air. Even if its supply is necessary, its quantity is much less than is needed by the conventional engines. Therefore, the air pump or other air supply means can be either dispensed with or reduced in capacity. These proposed engines have shortcomings too. The use of considerably richer and leaner air-fuel mixtures than the stoichiometric air-fuel ratio results in inadequate power output and, therefore, poor drivability especially under high load conditions. During high-speed drive, fuel economy drops. During heavy load operation, a vehicle with such powerless engine cannot make quick motion to avoid accident.

This invention eliminates the above-mentioned shortcomings. According to this invention, rich and lean mixtures are supplied to two groups of cylinders respectively set for their combustion during medium and low load operations. This permits purification of exhaust gas at high efficiency. During heavy load operation, substantially the same mixture is supplied to all the cylinders, thereby preventing output drop and increasing fuel economy.

Other objects and advantages of this invention will appear in the following description of some embodiments of this invention which is to be read by reference to the accompanying drawings, in which.

Figure 1:
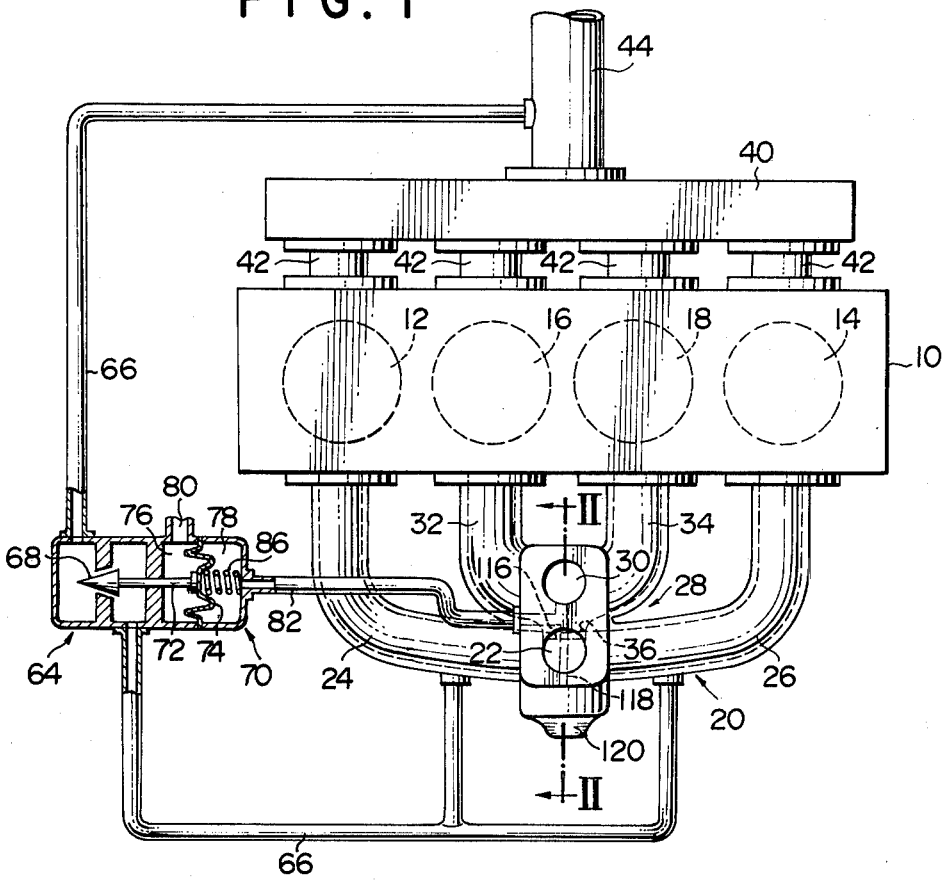
FIG. 1 is a schematic illustration of a first embodiment of this invention.
Figure 3:
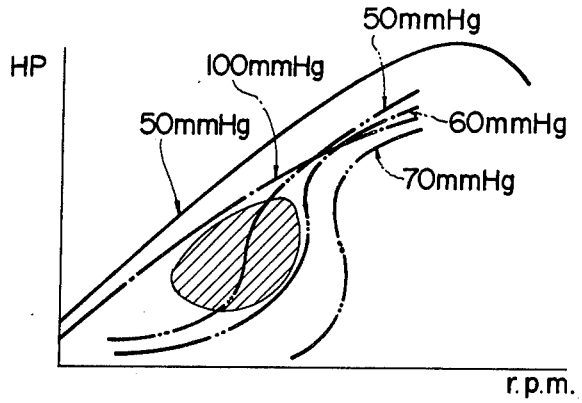
FIG. 3 shows characteristic curves of mixed and manifold vacuums expressed in terms of the relationship between engine speed and output.
Figure 2:
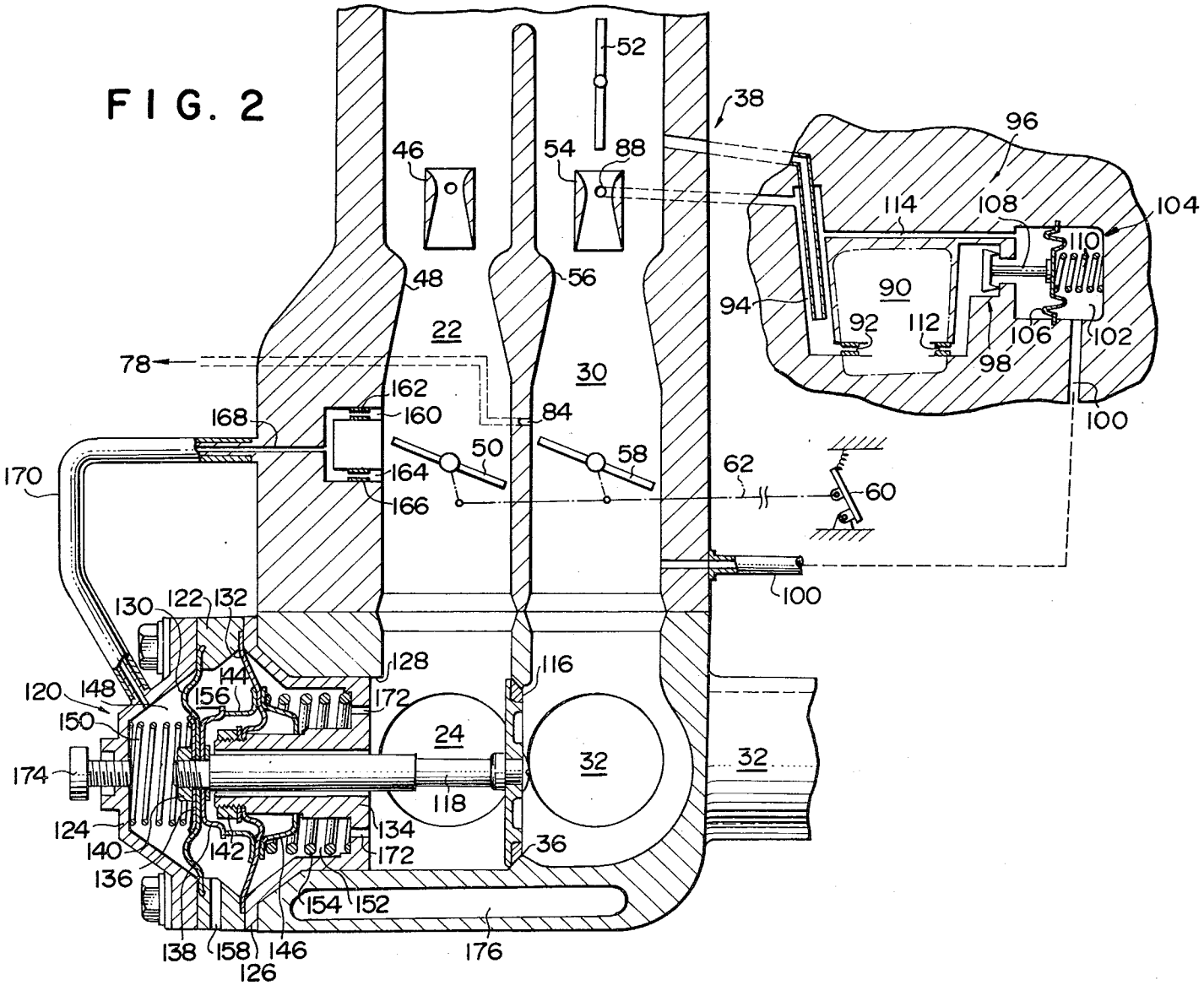
FIG. 2 is a cross-sectional view taken along the line II-II of FIG. 1.

In the first embodiment of this invention shown in FIGS. 1 through 3, reference numeral 10 denotes an engine proper having cylinders for rich mixture 12 and 14 and cylinders for lean mixture 16 and 18. Numeral 20 is a rich mixture intake manifold comprising branched pipes 24 and 26 which supply rich mixture from a rich mixture forming device 22 to said rich mixture cylinders 12 and 14. Numeral 28 is a lean mixture intake manifold comprising branched pipes 32 and 34 which supply lean mixture from a lean mixture forming device 30 to said lean mixture cylinders 16 and 18. Reference numeral 36 designates a manifold connecting port through which the base portions of said intake manifolds 20 and 28 communicate with each other. It is prefereable that the diameter of this connecting port 36 be substantially the same as that of the passages of said mixture forming devices. Numeral 38 is a carburetor comprising said rich mixture forming device 22 and lean mixture forming device 30. Reference numeral 40 designates a thermal reactor into which exhaust gases from the cylinders 12, 14, 16 and 18 flow through an exhaust manifold 42. The exhaust gases recombusted in the thermal reactor 40 is discharged into the atmosphere through an exhaust pipe 44.

The rich mixture forming devices 22 comprises an inner venturi 46, outer venturi 48 and throttle valve 50. The lean mixture forming device 30 comprises a choke valve 52, inner venturi 54, outer venturi 56 and throttle valve 58. The throttle valves 50 and 58 are interlocked with each other, and actuated by an accelerator pedal 60 through a linkage or cable 62.

To the branches 24 and 26 of said rich mixture intake manifold 20 is connected an exhaust-gas recirculating passage 66 through which part of the exhaust gas discharged through said exhaust pipe 44 is recirculated by way of a flow-rate control valve 64. The control valve 64 comprises a valve body 68 that opens and closes said recirculating passage 66 and a pressure-responsive device 70 to actuate said valve body 68. The pressure-responsive device 70 has two chambers 76 and 78 that are separated by a diaphragm 74 connected to said valve body 68 through a rod 72. The one chamber 76 opens to the atmosphere through an opening 80. The other chamber 78, in which a spring 86 is provided, communicates by means of a passage 82 with a port 84 provided in the wall of the intake passage somewhat upstream of the throttle valve 58 in the perfectly closed position. The spring 86 always urges the valve body toward its closing position through the diaphragm 74 and rod 72.

The spring 86 is urged with such force that when vacuum at the port 84 (hereinafter called the EGR vacuum) exceeds 100 mmHg, for instance, the diaphragm 74 moves to the right in the figure to open the recirculating passage 66.

A known enrichment system 96 is added to a main fuel passage 94 that supplies fuel from a float chamber 90, through a main jet 92, to a main nozzle 88 opening into said inner venturi 54. The enrichment system 96 has an enrichment valve 98 that increases the quantity of fuel supplied to the main fuel passage 94 and a vacuum operating device 104 having a vacuum chamber 102 into which manifold vacuum downstream of the throttle valve 58 is introduced through a vacuum passage 100. The enrichment valve 98 is connected through a rod 108 to a diaphragm 106 that defines the vacuum chamber 102. When the manifold vacuum introduced into the vacuum chamber 102 falls below 100 mmHg, for instance, the enrichment valve 98 is opened by the urging force of a spring 110. When said enrichment valve 98 opens, fuel is supplied from the float chamber 90 through an orifice 112 and passage 114 to the main fuel passage 94, as a result of which the quantity of fuel injected from the main nozzle 88 increases.

Numeral 116 is an open-and-close valve fitted in the manifold connecting port 36, which is connected to a pressure-responsive device 120 through a rod 118. The pressure-responsive device 120 comprises hollow end casings 124 and 126 integrally fixed on both sides of a circular intermediate casing 122. The end casing 126 is fitted in an opening 128 made in the base portion of the rich mixture intake manifold 20. The periphery of a first diaphragm 130 is held between said end casing 124 and intermediate casing 122, and that of a second diaphragm 132 between the end casing 126 and intermediate casing 122. The center of said first diaphragm 130 is held between a washer-like support plate 136 and a cup-shaped support plate 138 and fixed with a nut 140 to one end of said rod 118 that passes through a central opening in a projection 134 protruding inward from that end of said casing 126 which is opposite to said diaphragm 132. The center of the second diaphragm 132 is fixed with a nut 142 to a stepped portion formed at the extreme end of said projection 134. Reference numeral 144 denotes a hollow cylindrical stopper plate whose one end is adapted to contact the bent periphery of said support plate 138. Numeral 146 is a stopper plate that is fixed to said second diaphragm 132 and mounted on said projection 134. Reference numeral 148 designates a first chamber defined by the first diaphragm 130 and casing 124, in which a first coil spring 150 is placed. Reference numeral 152 represents a second chamber defined by the second diaphragm 132 and casing 126, in which a second coil spring 154, which has greater urging force than said first coil 150, is provided. A space 156 defined by said first and second diaphragms 130 and 132 and intermediate casing 122 opens to the atmosphere through an opening 158 made in the intermediate casing 122. Numeral 160 is a first vacuum passage having an orifice 162 that is provided slightly upstream of the throttle valve 50 in the perfectly closed position. Numeral 164 is a second vacuum passage having an orifice 166 that is provided slightly downstream of the throttle valve 50 in the perfectly closed position. Reference numeral 168 designates a mixed vacuum passage through which a mixture of the vacuums in said first and second vacuum passages 160 and 164 is taken out. This mixed vacuum passage 168 communicates with said first chamber 148 by way of a conduit 170. Numeral 172 is a third vacuum passage made in said casing 126, which connects the second chamber 152 with the rich mixture intake manifold 20. A stopper bolt 174 is screwed into said casing 124 so as to contact one end of the rod 118, thereby restricting the maximum opening of said open-and-close valve 116. Numeral 176 is a heat riser for heating the air-fuel mixture through which water for cooling the engine proper 10 passes.

It is known that mixed vacuum in said mixed vacuum passage 168 changes as shown by a two-dot-dash line in FIG. 3 when the diameters of the orifices 162 and 166 are suitably selected. In FIG. 3, a dot-dash line is a plot of 100 mmHg vacuum and a solid line is that of manifold vacuum (approximately 50 mmHg) when the throttle valve is fully open.

Let us assume that the urging force of the first coil spring 150 is such that the first diaphragm 130 moves to the left when mixed vacuum exceeds 60 mmHg, and that the urging force of the second coil spring 154 is such that the second diaphragm 132 moves to the right when manifold vacuum exceeds 100 mmHg. In the partial load region (hatched in FIG. 3) where NOx is likely to occur, the second diaphragm 132 is on the right (as shown in FIG. 2) when manifold vacuum exceeds 100 mmHg. Because mixed vacuum is lower than 60 mmHg, the first diaphragm 130 also is urged to the right (as shown in FIG. 2) by the first coil spring 150. Accordingly, the open-and-close valve 116 moves to the right, by means of the rod 118 fixed to the first diaphragm 130, to close the manifold connecting port 36. Then, a rich mixture with air-fuel ratio of 12 to 14, for instance, prepared in the rich mixture forming device 22 is supplied to the rich mixture cylinders 12 and 14, and a lean mixture with air-fuel ratio of 17 to 20, for instance, prepared in the lean mixture forming device 30 is supplied to the lean mixture cylinders 16 and 18. At this time said EGR vacuum exceeds 100mmHg, and the flow-rate control valve 64 opens to pass part of exhaust gas back to the rich mixture cylinders 12 and 14 through the exhaust-gas recirculating passage 66 and rich mixture intake manifold 20. The enrichment system 96 is inoperative, with the enrichment valve 98 being closed, because manifold vacuum exceeding 100 mmHg is introduced in the vacuum chamber 102. In the high load region where the throttle valves 50 and 58 are substantially fully open, manifold vacuum drops below 100 mmHg, whereupon the second diaphragm 132 is urged to the left by the second coil spring 154. Meanwhile, mixed vacuum falls below 60 mmHg and the first diaphragm 130 tends to move to the right under the influence of the urging force of the first coil spring 150. But the urging force of the second coil spring 154 is greater than that of the first coil spring 150. So the greater urging force of the second coil spring 154 acts through the stopper plate 144 and support plate 138 on the first diaphragm 130 to move it to the left. As a result, the open-and-close valve 116 also moves to the left, by means of the rod 118 fixed to the first diaphragm 130, to open the manifold connecting port 36. Since manifold vacuum is lower than 100 mmHg at this time, the spring 110 opens the enrichment valve 98. So the enrichment system 96 operates to supply fuel from the float chamber 90 through the orifice 112 and passage 114 to the main fuel passage 94. As a consequence, more fuel is supplied to the lean mixture forming device 30, and air-fuel ratio of mixture formed therein drops to between, for instance, 15 and 18. The mixing of the mixtures prepared in the rich and lean mixture forming devices 22 and 30 increases the quantity and sets the air-fuel ratio at somewhere between 13 and 15, for instance, of the mixture supplied to the cylinders 12, 14, 16 and 18. Namely, air-fuel mixture that is adequate for high load operation, both in quantity and air-fuel ratio, is supplied.

In the low-load high-speed operation region where manifold vacuum exceeds 100 mmHg, the second diaphragm 132 is on the right (as shown in FIG. 2). Because mixed vacuum also exceeds 60 mmHg, the first diaphragm 130 moves to the left against the urging force of the first coil spring 150. At this time, the stopper plate 144 and the support plate 138 separate from each other. So the open-and-close valve 116 moves to the left, by means of the rod 118 fixed to the first diaphragm 130, to open the manifold connecting port 36. Since manifold vacuum exceeds 100 mmHg then, the enrichment system 96 is inoperative and air-fuel mixture prepared in the lean mixture forming device 30 has as high an air-fuel ratio as, for instance, between 17 and 20. Therefore, a mixture of air-fuel mixtures prepared in the rich and lean mixture forming devices 22 and 30, with air-fuel ratio of, for instance, 14 to 17, is supplied to the cylinders 12, 14, 16 and 18.

As described above, the open-and-close valve 116 of this embodiment does not open in the region where NOx is particularly likely to be emitted as shown in FIG. 3. Therefore, rich mixture is supplied to the rich mixture cylinders 12 and 14 and lean mixture to the lean mixture cylinders 16 and 18. In addition, exhaust gas is recirculated to the rich mixture cyliners 12 and 14. This lowers combustion temperature and pressure in each cylinder, and thereby reduces NOx emission. The uncombusted ingredients in the exhaust gas from the rich mixture cylinders 12 and 14 are recombusted in the thermal reactor 40 with residual oxygen in the exhaust gas from the lean mixture cylinders 16 and 18, and discharged therefrom into the atmosphere.

In the high-load or high-speed operation region, the open-and-close valve 116 opens to supply air-fuel mixture having substantially the same air-fuel ratio to all the cylinders 12, 14, 16 and 18. This increases engine output, prevents lowering drivability, and offers higher fuel economy.

Figure 4:
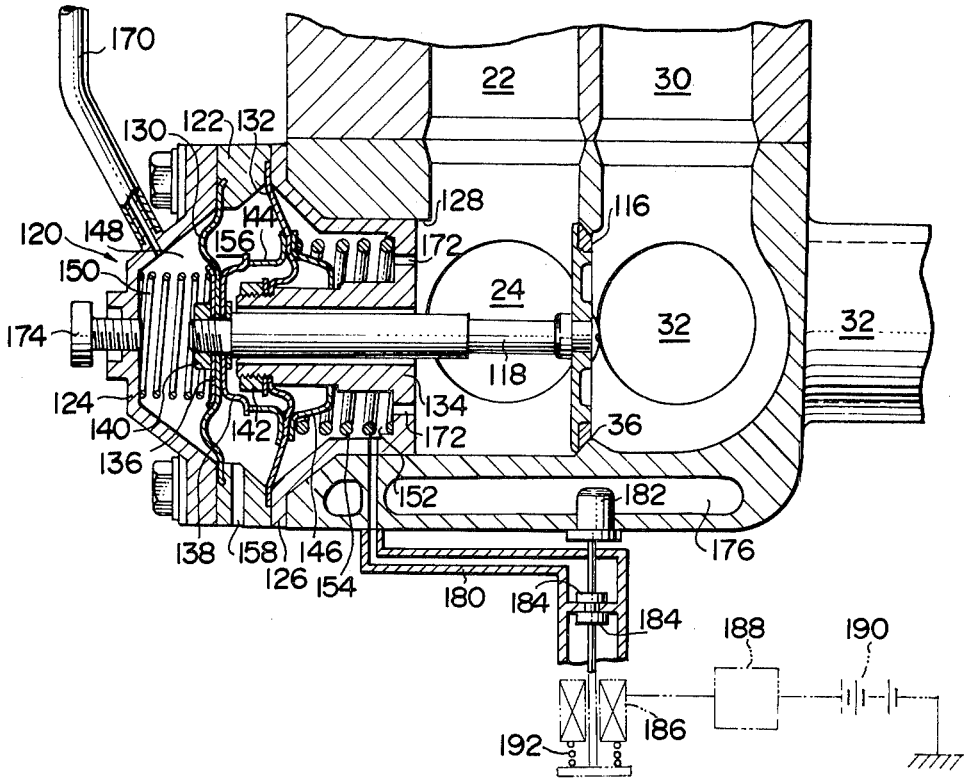
FIG. 4 is a cross section similar to FIG. 2, but showing a second embodiment of this invention.

Now a second embodiment of this invention will be described by reference to FIG. 4, wherein those parts which are or function similar to those in the first embodiment are designated by similar reference numerals without giving particular explanation.

This embodiment differs from the above-described first embodiment in that a passage opening to atmosphere 180 is provided in the second chamber 152 of the pressure-responsive device 120. A changeover valve 184 actuated by a thermosensor 182 is installed in said atmosphere passage 180. The thermosensor 182 is exposed in the heat riser 176 to detect the temperature of engine cooling water flowing therethrough. When the cooling water temperature exceeds a certain level, the thermosensor 182 actuates said changeover valve 184 to close said atmosphere passage 180.

When the cooling water temperature is below the certain level (such as when starting the engine), the changeover valve 184 opens the atmosphere passage 180 to introduce atmosphere into the second chamber 152. The second coil spring 154 moves the first diaphragm 130 to the left through the stopper plate 144 and support plate 138, whereupon the open-and-close valve 116 opens the manifold connecting port 36. In starting the engine, the choke valve 52 functions to lower the air-fuel ratio of mixture prepared in the lean mixture forming device 30. Therefore, a mixture at such air-fuel ratio as 10 or 11 that is suited for start-up is supplied to all the cylinders 12, 14, 16 and 18 for better startability. During warm-up (with the cooling water temperature below the certain level), the open-and-close valve 116 is still open and a mixture at substantially the same air-fuel ratio is supplied to all the cylinders 12, 14, 16 and 18 for stable operation. After warm-up (or when the cooling water temperature exceeds the certain level), this embodiment operates like the previously described first embodiment.

As assumed by a two-dot-dash line in FIG. 4, provision can be made so that the changeover valve 184 be actuated by a solenoid 186 that is connected to a power supply 190 through an engine speed detector 188 that breaks the circuit when the number of engine rotation drops below a certain level (for instance, during idling at 1,000 r.p.m. or under), and the changeover valve 184 is opened by a spring 192 when the solenoid 186 becomes deenergized. Then, when the engine rotates slowly, the changeover valve 116 opens to supply a mixture having substantially the same air-fuel ratio to all the cylinders 12, 14, 16 and 18, thereby permitting stable engine operation and facilitating adjustment of the carburetor 38 during idling.

Figure 5:
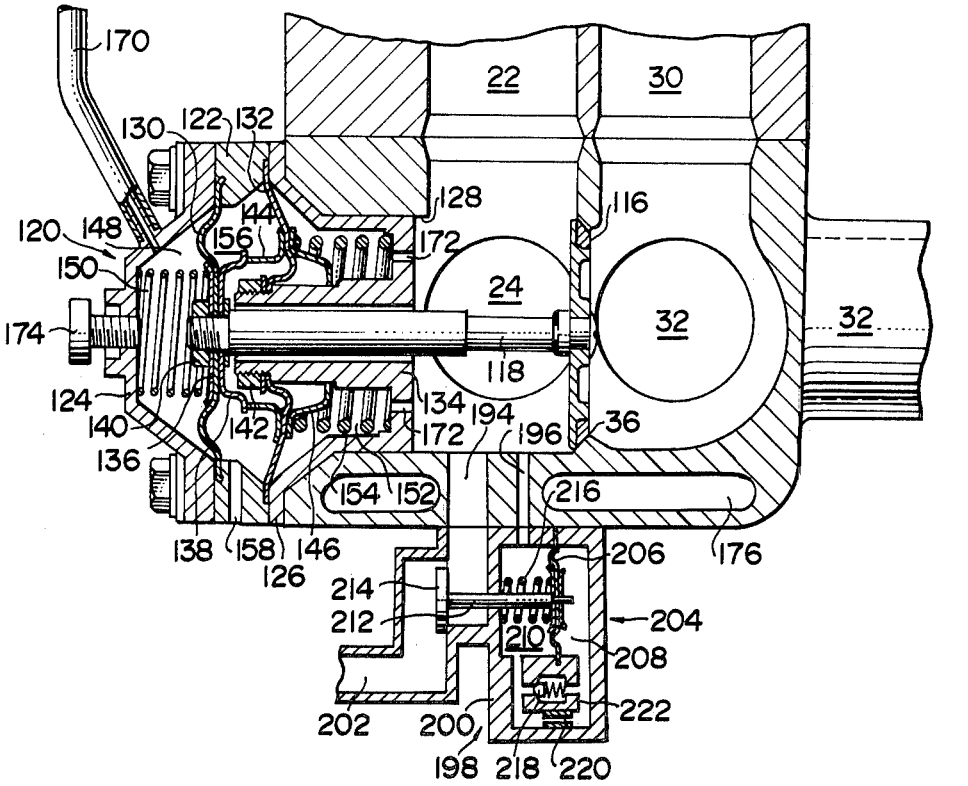
FIG. 5 is a cross section similar to FIG. 2, but showing a third embodiment of this invention.

Next, a third embodiment of this invention will be described by reference to FIG. 5. As with the second embodiment, those parts which are or function similar to those of the first embodiment will be represented by similar reference numerals and will not be specifically explained.

This third embodiment differs from the first embodiment in that a mixture control valve 198 is fitted through an air passage 194 and a vacuum passage 196 to the rich mixture intake manifold 20. The mixture control valve 198 comprises a housing 200 that is divided into an air pipe 202 and a vacuum chamber 204, and the air passage 194 communicates with the air pipe 202. The vacuum chamber 204 is partitioned by a diaphragm 206 into a first vacuum chamber 208 and a second vacuum chamber 210. The second vacuum chamber 210 communicates with the rich mixture intake manifold 20 by the vacuum passage 196. The diaphragm 206 is connected through a valve rod 212 to an air control valve 214 fitted in the air pipe 202. This air control valve 214 is always urged toward the closing position by means of the diaphragm 206 urged by a coil spring 216 in the second vacuum chamber 210. The first and second vacuum chambers 208 and 210 communicate with each other by means of a duct 222 in which a check valve 218 and an orifice 220 are provided in parallel. The coil spring 216 urges the diaphragm 206 to the left to open the air control valve 214 when manifold vacuum becomes great (for instance, 500 mmHg or above).

During deceleration when manifold vacuum exceeds 500 mmHg, the air control valve 214 opens to supply air into the rich mixture intake manifold 20. After a certain time, the pressure in the first and second vacuum chamber 208 and 210 becomes balanced by the action of the orifice 220, whereupon the air control valve 214 is closed by the coil spring 216. When the engine is accelerated before the aforesaid certain time has passed, the check valve 218 operates to instantly balance the pressure in the first and second vacuum chambers 208 and 210. Therefore, the air control valve 214 can be operated surely when decelerating the engine next time.

This embodiment therefore can prevent the air-fuel ratio of mixture supplied during deceleration particularly to the rich mixture cylinders 12 and 14 from lowering to, for instance, between 9 and 11 by supplying air into the rich mixture intake manifold 20. This in turn prevents incomplete combustion of fuel due to air shortage, plentiful emission of such noxious gases as HC and CO, and occurrence of afterburning. It offers the same operations and results as the first embodiment, too.

In the above-described third embodiment, the mixture control valve 198 is provided in the rich mixture intake manifold 20. If it is installed in the lean mixture intake manifold, it will achieve similar operations and results in the lean mixture cylinders 16 and 18.

If the passage diameter of the lean mixture forming device 30 is made larger than that of the rich mixture forming device 22 in all the above-described embodiments, the lean mixture cylinders 16 and 18 admit more mixture than the rich mixture cylinders 12 and 14, whereby the output unbalance between them, which arises when the open-and-close valve 116 closes, can be eliminated. It is then preferable that the diameter of the connecting port 36 be substantially equal to the passage diameter of the lean mixture forming device 30. Also, it is of course possible to use the above-described embodiments in combination.

What is claimed is:

1. A multicylinder internal combustion engine comprising cylinders to which rich air-fuel mixture is supplied, cylinders to which lean air-fuel mixture is supplied, a rich mixture intake manifold supplying mixture from a rich mixture forming device to said rich mixture cylinders, a lean mixture intake manifold supplying mixture from a lean mixture forming device to said lean mixture cylinders, a manifold connecting port through which said two manifolds communicate with each other, an open-and-close valve installed in said connecting port, a pressure-responsive device that has a first and a second movable diaphragms vertically spaced in casing and comprises a first chamber defined by said first movable diaphragm and casing and a second chamber defined by said second movable diaphragm and casing, a rod that connects said first movable diaphragm to said open-and-close valve to actuate the valve, a mixed vacuum passage through which a mixture of vacuum in a first vacuum passage communicating with an intake passage upstream of a throttle valve in the perfectly closed position and vacuum in a second vacuum passage communicating with an intake passage downstream of the throttle valve in the perfectly closed position, a third vacuum passage connecting said second chamber to at least either of said rich and lean mixture intake manifolds, a conduit connecting said first chamber to said mixed vacuum passage, a first spring that always urges said open-and-close valve toward the closing position, and a second spring that always urges said open-and-close valve toward the opening position with greater force than said first spring.

2. A multicylinder internal combustion engine in accordance with claim 1, comprising an exhaust-gas recirculating passage that connects the engine exhaust system to at least either of said rich and lean mixture intake manifolds.

3. A multicylinder internal combustion engine in accordance with claim 1, comprising an atmosphere passage connecting the second chamber of said pressure-responsive device to the atmosphere, a control valve installed in said atmosphere passage, and a valve control device adapted to actuate said control valve to close said atmosphere passage when the temperature of engine cooling water exceeds a certain level.

4. A multicylinder internal combustion engine in accordance with claim 1, comprising an atmosphere passage connecting the second chamber of said pressure-responsive device to the atmosphere, a control valve installed in said atmosphere passage, and a valve control device adapted to actuate said control valve to open said atmosphere passage when the number of engine rotation exceeds a certain level.

5. A multicylinder internal combustion engine in accordance with claim 1, comprising an air passage connecting at least either of said rich and lean mixture intake manifolds with the atmosphere, an air control valve installed in said air passage, and a valve control device adapted to actuate said air control valve to open said air passage when the engine is decelerated.

6. A multicylinder internal combustion engine in accordance with claim 1, wherein the passage diameter of said lean mixture forming device is greater than the passage diameter of said rich mixture forming device.

* * * * *